US007744209B2

(12) United States Patent
Nakashima

(10) Patent No.: US 7,744,209 B2
(45) Date of Patent: Jun. 29, 2010

(54) MEDIA CONVEYANCE SYSTEM OF AN INK EJECTION IMAGE FORMING APPARATUS

(75) Inventor: Atsuhisa Nakashima, Nagoya (JP)

(73) Assignee: Brother Kogyo Kabushiki Kaisha, Nagoya-shi, Aichi-ken ( * ) Notice: Subject to any disclaimer, the term of this patent is extended or adjusted under 35 U.S.C. 154(b) by 382 days.

(21) Appl. No.: 11/357,102

(22) Filed: Feb. 21, 2006

(65) Prior Publication Data

US 2006/0187290 A1 Aug. 24, 2006

(30) Foreign Application Priority Data

Feb. 21, 2005 (JP) ..... 2005-044037

(51) Int. Cl.
*B41J 2/01* (2006.01)

(52) U.S. Cl. ..... 347/104; 347/9; 347/100; 347/101; 347/102; 347/213; 353/113; 271/264; 271/271; 271/272; 399/302; 399/328; 399/329; 493/434; 358/498

(58) Field of Classification Search ..... None
See application file for complete search history.

(56) References Cited

U.S. PATENT DOCUMENTS

| | | | | |
|---|---|---|---|---|
| 3,645,612 | A * | 2/1972 | Streicher et al. | 353/27 R |
| 5,606,357 | A * | 2/1997 | Bekki | 347/104 |
| 5,795,087 | A | 8/1998 | Brower et al. | |
| 6,137,600 | A * | 10/2000 | Sakurai et al. | 358/498 |
| 6,712,463 | B2 * | 3/2004 | Matsumoto | 347/104 |
| 2002/0021342 | A1 * | 2/2002 | Kawazoe et al. | 347/104 |
| 2002/0060423 | A1 | 5/2002 | Shibabuki | |
| 2002/0168203 | A1 * | 11/2002 | Sasaki | 399/344 |
| 2003/0230847 | A1 * | 12/2003 | Shikahama et al. | 271/264 |
| 2004/0251618 | A1 | 12/2004 | Niizeki | |
| 2005/0024464 | A1 | 2/2005 | Takagi | |
| 2005/0200678 | A1 * | 9/2005 | Gao et al. | 347/104 |

FOREIGN PATENT DOCUMENTS

| | | | |
|---|---|---|---|
| EP | 0395887 | A1 | 11/1990 |
| EP | 0882665 | A2 | 12/1998 |
| JP | S58181668 | A | 10/1983 |
| JP | 1 64943 | | 4/1989 |

(Continued)

OTHER PUBLICATIONS

Office Action Mailed Nov. 2, 2007, in corresponding Chinese patent application.

(Continued)

*Primary Examiner*—Matthew Luu
*Assistant Examiner*—John P Zimmermann
(74) *Attorney, Agent, or Firm*—Baker Botts, LLP.

(57) ABSTRACT

In an image forming apparatus, a nip roller group for pressing a face of a conveyance belt on which a recording medium is held includes a pair of first end pressing parts which are arranged in the width direction of the conveyance belt at a distance corresponding to the recording medium having a predetermined size, and a first center pressing part which is arranged between the pair of first end pressing parts. Herein, a pressing force of the first center pressing part is set to be smaller than pressing forces of the first end pressing parts.

12 Claims, 5 Drawing Sheets

FOREIGN PATENT DOCUMENTS

| | | | |
|---|---|---|---|
| JP | 2 86475 | | 3/1990 |
| JP | H05-020277 | B | 3/1993 |
| JP | H05-046450 | A | 6/1993 |
| JP | 07025097 | A | 1/1995 |
| JP | H10-329972 | A | 12/1998 |
| JP | 2002-154698 | A | 5/2002 |
| JP | 2002-308462 | A | 10/2002 |
| JP | 2005-001865 | A | 1/2005 |
| WO | WO 2004113209 | A1 * | 12/2004 |

OTHER PUBLICATIONS

European Patent Office, European Search Report for Related EP Application No. 06250669 dated Jun. 16, 2006.

Japan Patent Office; Office Action in Japanese Patent Application No. 2005-044037 (counterpart to the above-captioned U.S. patent application) mailed Feb. 16, 2010.

* cited by examiner

MEDIA CONVEYANCE SYSTEM OF AN INK EJECTION IMAGE FORMING APPARATUS

CROSS-REFERENCE TO RELATED APPLICATION

This non-provisional application claims priority under 35 U.S.C. §119(a) on Patent Application No. 2005-044037 filed in Japan on Feb. 21, 2005, the entire contents of which are hereby incorporated by reference.

BACKGROUND

The present invention relates to an image forming apparatus. In particular, the present invention relates to an image forming apparatus which suppresses a change in conveying speed of a conveyance belt and floating of a recording medium, thereby preventing degradation of image quality.

In an image forming apparatus which forms a desired image on a recording medium held on an endless conveyance belt, generally, floating of the recording medium held on the conveyance belt tends to occur. Such floating makes it difficult to maintain the recording medium at a horizontal state with respect to a recording head for ejecting ink, resulting in degradation of image quality.

In order to solve such a problem, Japanese Patent Application Laid-Open No. 2-86475 (1990) discloses a technique that a columnar pinch roller (nip roller means) is disposed on a transferring face of a belt (conveyance belt). According to this technique, a recording medium held on the belt is pressed by the pinch roller; therefore, it is possible to suppress floating of the recording medium from the belt to thereby prevent degradation of image quality.

SUMMARY

In general, a transferring face of a conveyance belt is subjected to silicon treatment or the like to secure an adhesion force for holding a recording medium. Thus, it is possible to prevent the recording medium from sliding on the conveyance belt, and to transfer the recording medium with reliability.

If the transferring face of the conveyance belt is subjected to silicon treatment or the like, however, there arises a large difference between a coefficient of friction at the transferring face of the conveyance belt and a coefficient of friction at an image forming face of the recording medium. Due to this difference, there arises a large difference between a resistance in the case where the nip roller means comes into contact with the recording medium and a resistance in the case where the nip roller means comes into contact with the conveyance belt. Such a resistance difference causes a difference between a conveying speed of the conveyance belt in the case where the nip roller means comes into contact with the recording medium and a conveying speed of the conveyance belt in the case where the nip roller means comes into contact with the conveyance belt, i.e., a difference between a conveying speed of the conveyance belt when the recording medium is nipped and conveyed and a conveying speed of the conveyance belt after the recording medium has been nipped and conveyed. As a result, a change in conveying speed of the conveyance belt immediately after the recording medium has been nipped and conveyed becomes large, resulting in degradation of image quality.

On the other hand, if the pressing force of the nip roller means is weakened for the purpose of suppressing such a change in conveying speed, floating of the recording medium occurs as described above, resulting in degradation of image quality.

Therefore, in order to solve the above problems, and it is an object to provide an image forming apparatus which suppresses a change in conveying speed of a conveyance belt and floating of a recording medium, thereby preventing degradation of image quality.

In order to achieve this object, an image forming apparatus according to the first aspect is an image forming apparatus comprising: an endless conveyance belt which holds and conveys a recording medium; nip roller unit which presses a face of the conveyance belt on which the recording medium is held, and rotates in accordance with movement of the conveyance belt; and a recording head which has a plurality of ink ejecting holes, transferring the recording medium pressed against the holding face of the conveyance belt by the nip roller unit, and ejecting ink from the plurality of ink ejecting holes to thereby form an image on the recording medium, characterized in that the nip roller unit includes a pair of first end pressing parts arranged in the width direction of the conveyance belt at a distance corresponding to the recording medium having a first size, and a first center pressing part arranged between the first end pressing parts, and a pressing force of the first center pressing part toward the conveyance belt is set to be smaller than pressing forces of the pair of first end pressing parts toward the conveyance belt.

It is to be noted that the nip roller unit includes a plurality of nip rollers for pressing the face of the conveyance belt on which the recording medium is held. Examples of a mode of the nip roller unit include a mode that the plurality of nip rollers are integrally provided, and a mode that the plurality of nip rollers are separately provided so as to be rotatable independently.

In the image forming apparatus according to the first aspect, the nip roller unit presses the holding face of the endless conveyance belt for holding and transferring the recording medium, rotates in accordance with movement of the conveyance belt, and includes the pair of first end pressing parts arranged in the width direction of the conveyance belt at a distance corresponding to the recording medium having a first size and the first center pressing part arranged between the pair of first end pressing parts. In addition, a pressing force of the first center pressing part toward the conveyance belt is set to be smaller than pressing forces of the pair of first end pressing parts toward the conveyance belt. Therefore, the pressing force of the entire nip roller unit can be lowered while both ends of the recording medium in the width direction are pressed with sufficient pressing force. With this configuration, the image forming apparatus according to the first aspect can produce effects that it is possible to prevent floating of the recording medium from the conveyance belt, and to suppress a change in conveying speed caused due to presence/absence of the recording medium between the nip roller unit and the conveyance belt to thereby prevent degradation of image quality.

The above and further objects and features will more fully be apparent from the following detailed description with accompanying drawings.

DETAILED DESCRIPTION OF THE EXEMPLARY EMBODIMENTS

Figure 1:
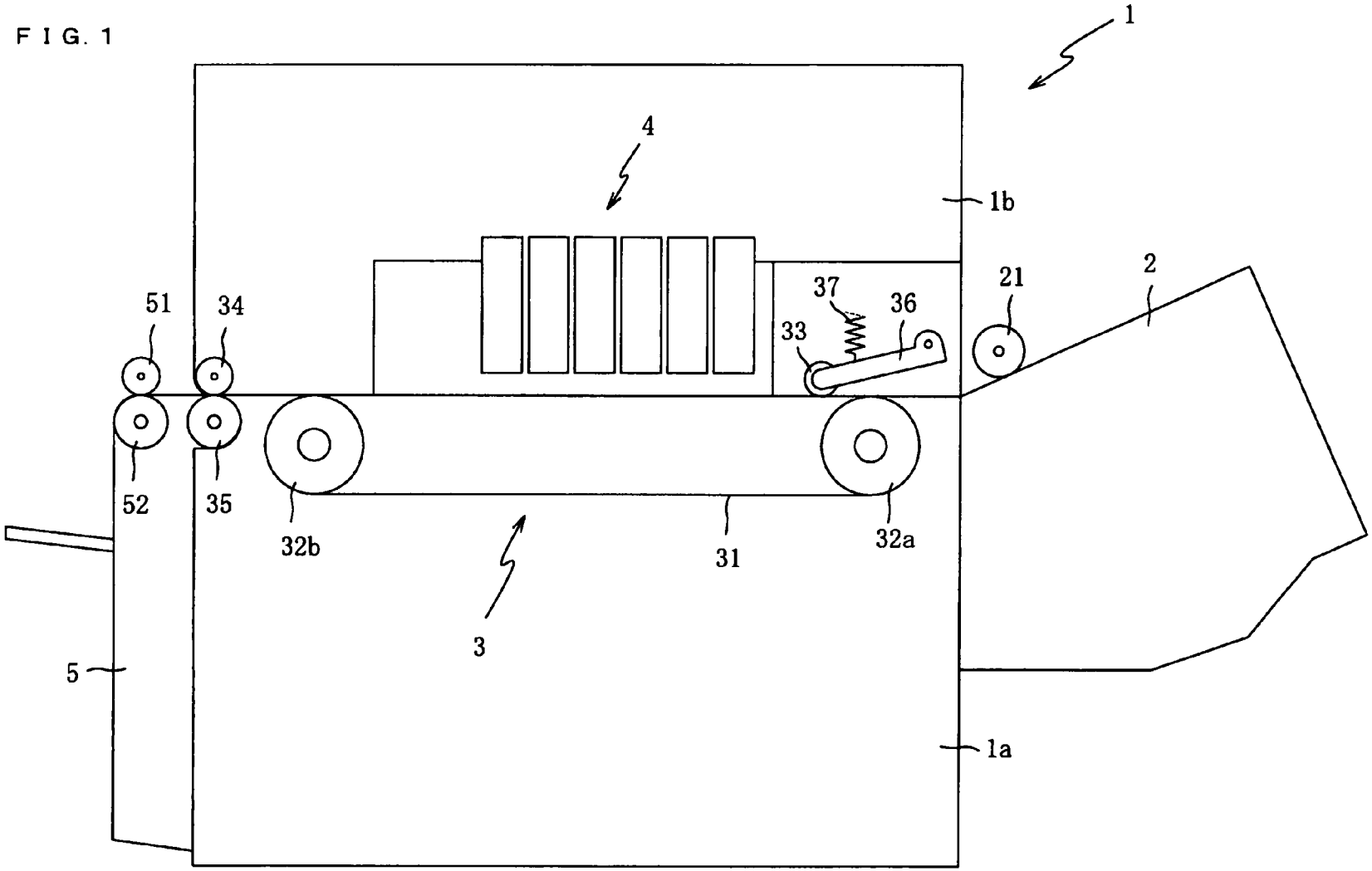
FIG. 1 is a schematic view of an image forming apparatus according to a first embodiment.

Hereinafter, description will be given of preferred embodiments with reference to the accompanying drawings. FIG. 1 is a schematic view of an image forming apparatus 1 according to a first embodiment. First, description will be given of an overall configuration of the image forming apparatus 1 with reference to FIG. 1.

The image forming apparatus 1 mainly comprises a supply unit 2 which supplies a recording medium 22 (see FIG. 2B) to a main body 1*a*, a conveying unit 3 which conveys the recording medium 22 supplied from the supply unit 2, a recording head 4 which ejects ink onto the recording medium 22 conveyed by the conveying unit 3 to form an image, and a stacker 5 which stocks the recording medium 22 on which the image is formed by the recording head 4.

The supply unit 2 includes a tray (not illustrated) which contains the recording medium 22, and a pickup roller 21 which comes into contact with the recording medium 22 contained in the tray. When the pickup roller 21 is driven to rotate in a clockwise direction in FIG. 1, the recording medium 22 is supplied to the conveying unit 3 located at a downstream side (a left side in FIG. 1).

The conveying unit 3 is provided with a recording medium conveyance path for transferring the recording medium 22 supplied from the supply unit 2 toward the stacker 5. The recording medium conveyance path is mainly formed of an endless conveyance belt 31 wound between two driving rollers 32*a* and 32*b*. A face of the conveyance belt 31 on which the recording medium 22 is held, i.e., an outer peripheral face of the conveyance belt 31 is subjected to silicon treatment. The recording medium 22 is conveyed while being nipped between the conveyance belt 31 and a nip roller group 33 located at an upstream side (a right side in FIG. 1). When the driving roller 32*b* is driven to rotate in a counterclockwise direction in FIG. 1, the recording medium 22 can be conveyed toward the downstream side while being held at the conveyance belt 31 by an adhesion force thereof.

At the time of maintenance, the conveyance belt 31 in this embodiment can move in a vertical direction to a position where maintenance means (a cap, a pump and the like for a purge operation) are arranged.

The nip roller group 33 (nip roller means) is used for pressing the recording medium 22 supplied from the supply unit 2 toward the conveyance belt 31 (a lower side in FIG. 1). The nip roller group 33 is pivotally supported in a rotatable manner by an arm member 36 attached to the main body 1*a*. The arm member 36 has a spring 37 for biasing toward the conveyance belt 31, and can press the recording medium 22 held on the conveyance belt 31. Details thereof will be described later.

A pair of paper discharge rollers 34 and 35 are disposed at the downstream side of the conveyance belt 31, and discharge the recording medium 22 conveyed by the conveyance belt 31 to the stacker 5.

The recording head 4 is fixed to a head unit 1*b* in such a manner that the longitudinal direction thereof is the width direction of the recording medium 22 (in a direction perpendicular to the paper face of FIG. 1). A face of the recording head 4, which opposes the conveyance belt 31, is provided with a plurality of ink ejecting holes for ejecting ink. When the recording medium 22 conveyed by the conveyance belt 31 passes through a portion below the ink ejecting holes (a lower portion in FIG. 1), ink droplets are ejected toward an upper face, i.e., an image forming face of the recording medium 22; thus, a desired image is formed on the recording medium 22.

The recording head 4 in this embodiment is a so-called line-type recording head fixed to a main body. However, the recording head 4 may be configured to be movable to a position where maintenance means are arranged at the time of maintenance.

Further, the recording head 4 in this embodiment is configured by six recording heads of cyan, light cyan, magenta, light magenta, yellow and black; thus, a desired color image can be formed on the recording medium 22. Herein, the recording head 4 may be configured by four recording heads of cyan, magenta, yellow and black, or may be configured by more than six recording heads.

The head unit 1*b* is pivotally supported at the downstream side (the left side in FIG. 1) of the conveyance belt 31 of the main body 1*a*, and can turn in a vertical direction (in a vertical direction in FIG. 1). With this configuration, a jamming process for discharging paper can be performed at the supply unit 2 side.

The stacker 5 is used for stocking the recording medium 22 on which an image is formed. The recording medium 22 discharged from the conveying unit 3 is conveyed while being nipped between a pair of paper discharge rollers 51 and 52 located at the downstream side of the paper discharge rollers 34 and 35, thereby being led to the stacker 5.

Next, description will be given of the nip roller group 33 with reference to FIGS. 2A and 2B.

Figure 2A:
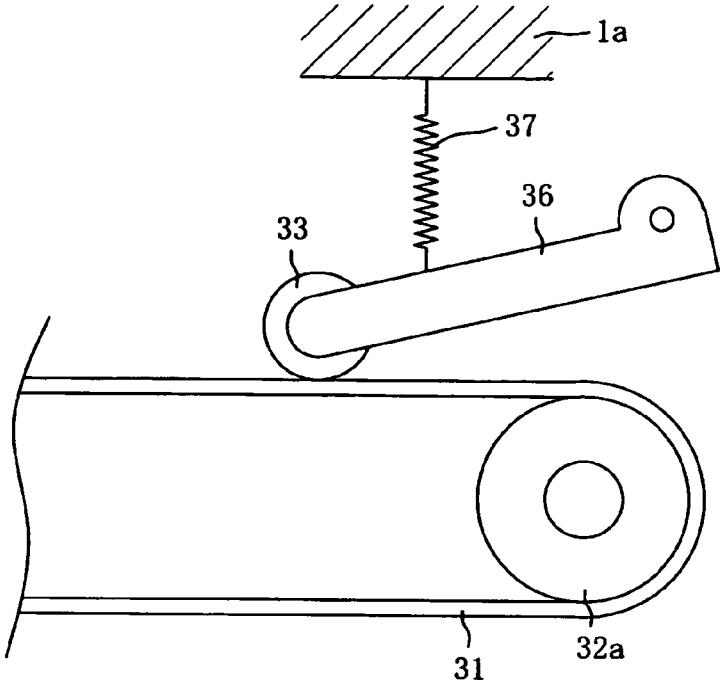
FIG. 2A is a side view of a nip roller group.
Figure 2B:
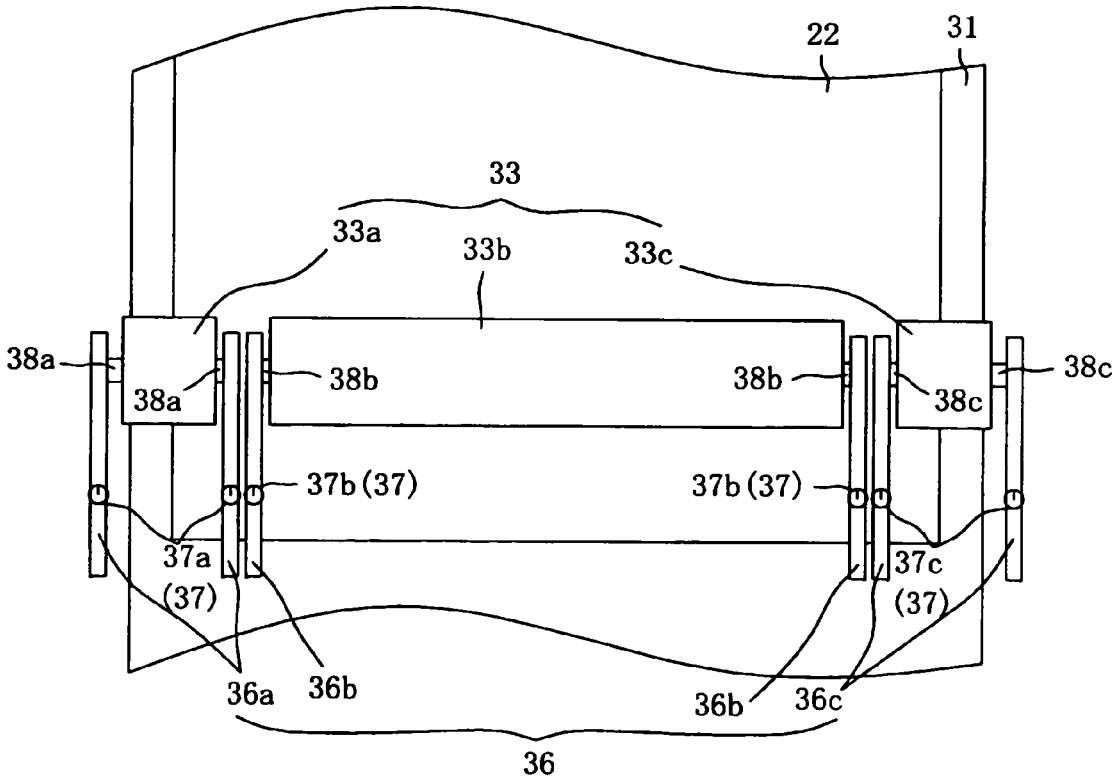
FIG. 2B is a top view of the nip roller group.

FIG. 2A is a side view of the nip roller group 33, and FIG. 2B is a top view of the nip roller group 33. Herein, lengths in the longitudinal direction of the main body 1*a* and the conveyance belt 31 are not illustrated in FIG. 2A, and lengths in the longitudinal direction of the recording medium 22, the conveyance belt 31, and the arm member 36 are not illustrated in FIG. 2B.

As illustrated in FIG. 2A, the conveyance belt 31 is wound around the driving roller 32*a* which rotates in a counterclockwise direction in FIG. 2A. A face (an upper side in FIG. 2A) of the conveyance belt 31, on which the recording medium 22 (see FIG. 2B) is held, is pressed by the nip roller group 33.

The nip roller group 33 is used for pressing the recording medium 22 held on the conveyance belt 31, and is pivotally supported by rotating shafts 38*a*, 38*b* and 38*c* which will be described later. Further, the nip roller group 33 presses the face of the conveyance belt 31 on which the recording medium 22 is held and, also, rotates in a clockwise direction in FIG. 2A in accordance with movement of the conveyance belt 31.

The arm member 36 has one end (a left side in FIG. 2A) serving as an attachment portion of the nip roller group 33 and the other end (a right side in FIG. 2A) pivotally supported by the main body 1*a*, and can turn in a vertical direction (in a vertical direction in FIG. 2A).

The arm member 36 is configured by a pair of arm members 36*a*, 36*b* and 36*c* which are attached in correspondence with first end pressing part 33*a* and 33*c* and a first center pressing part 33*b* which will be described later (see FIG. 2B).

The spring 37 has one end (the upper side in FIG. 2A) fixed to the main body 1*a* and the other end (a lower side in FIG. 2A) fixed to an upper end of the arm member 36, and can bias the arm member 36 toward the conveyance belt 31 (the lower side in FIG. 2A). With this biasing force, the arm member 36 is biased toward the conveyance belt 31, so that the nip roller group 33 can secure a pressing force to the conveyance belt 31.

Herein, the spring 37 is configured by springs 37*a*, 37*b* and 37*c* that can bias the arm members 36*a*, 36*b* and 36*c* toward the conveyance belt 31, respectively.

As illustrated in FIG. 2B, the nip roller group 33 is configured by the first end pressing parts 33*a* and 33*c* and the first center pressing part 33*b* that are divided along a conveying direction (a vertical direction in FIG. 2B). The first end pressing parts 33*a* and 33*c* and the first center pressing part 33*b* are pivotally supported by the rotating shaft 38*a*, 38*b* and 38*c*, respectively, and can rotate independently.

The first end pressing parts 33*a* and 33*c* and the first center pressing part 33*b* are formed to have the same diameter.

Each of the rotating shafts 38*a*, 38*b* and 38*c* has both ends fixed to each of the arm members 36*a*, 36*b* and 36*c*. The arm members 36*a*, 36*b* and 36*c* are biased toward the conveyance belt 31 (a back side of the paper face of FIG. 2B) by the springs 37*a*, 37*b* and 37*c* attached to the upper faces (a front side of the paper face of FIG. 2B) thereof, respectively.

With these biasing forces, the first end pressing parts 33*a* and 33*c* and the first center pressing part 33*b* press the conveyance belt 31. As illustrated in FIG. 2B, the first end pressing parts 33*a* and 33*c* and the first center pressing part 33*b* are arranged in a coaxial state where the rotating shafts 38*a*, 38*b* and 38*c* are substantially positioned in a line when the first end pressing parts 33*a* and 33*c* and the first center pressing part 33*b* press the conveyance belt 31.

It is to be noted that the end pressing means is used for providing pressing forces for biasing the first end pressing parts 33*a* and 33*c* toward the conveyance belt 31 to thereby press the conveyance belt 31, and corresponds to the arm members 36*a* and 36*c* and the springs 37*a* and 37*c* in this embodiment.

Similarly, the center pressing means is used for providing a pressing force for biasing the first center pressing part 33*b* toward the conveyance belt 31 to thereby press the conveyance belt 31, and corresponds to the arm member 36*b* and the spring 37*b* in this embodiment.

In this embodiment, the spring 37 is fixed to the arm member 36, thereby securing a pressing force of the nip roller group 33 toward the conveyance belt 31. It is not necessarily limited to this configuration. The spring 37 may be fixed to the rotating shafts 38*a*, 38*b* and 38*c*, thereby securing a pressing force of the nip roller group 33 toward the conveyance belt 31. Thus, the arm member 36 can be eliminated.

A pressing force given to the first center pressing part 33*b* by the center pressing means is smaller than pressing forces given to the first end pressing parts 33*a* and 33*c* by the pair of end pressing means. In other words, a biasing force of the spring 37*b* is set to be smaller than biasing forces of the springs 37*a* and 37*c*. Thus, a pressing force of the entire nip roller group 33 toward the recording medium 22 can be lowered; therefore, it is possible to make small a difference between a resistance in the case where the nip roller group 33 presses the recording medium 22 and a resistance in the case where the nip roller group 33 presses the conveyance belt 31. As a result, it is possible to make small a difference between a conveying speed in the case where the nip roller group 33 presses the recording medium 22 and a conveying speed in the case where the nip roller group 33 presses the conveyance belt 31. Accordingly, it is possible to suppress a change in conveying speed by presence/absence of the recording medium 22 between the nip roller group 33 and the conveyance belt 31 to thereby prevent degradation of image quality.

The pressing force of the first center pressing part 33*b* is set to be smaller than the pressing force of each of the first end pressing parts 33*a* and 33*c*, and is sufficiently secured. More specifically, since the pressing forces of the first end pressing parts 33*a* and 33*c* are set to be larger than the pressing force of the first center pressing part 33*b*, both ends of the recording medium 22 in the width direction (a lateral direction in FIG. 2B) can be strongly pressed toward the conveyance belt 31 (the back side of the paper face of FIG. 2B). As a result, the both ends of the recording medium 22 in the width direction can be prevented from being separated from the conveyance belt 31; therefore, it is possible to suppress partial floating of the recording medium 22 from the conveyance belt 31 to thereby prevent degradation of image quality.

In short, the both ends of the recording medium 22 in the width direction can be pressed with a sufficient pressing force and, also, the pressing force of the entire nip roller group 33 can be lowered in this embodiment; therefore, the following two effects can be achieved. That is, it is possible to prevent floating of the recording medium 22 from the conveyance belt 31, and to suppress a change in conveying speed between the case where the recording medium 22 is placed between the nip roller group 33 and the conveyance belt 31 and the case where the recording medium 22 is not placed between the nip roller group 33 and the conveyance belt 31 to thereby prevent degradation of image quality.

The rotating shafts 38*a*, 38*b* and 38*c* of the first end pressing parts 33*a* and 33*c* and the first center pressing part 33*b* are arranged coaxially along the width direction (the lateral direction in FIG. 2B) of the conveyance belt 31. With this configuration, a timing that the recording medium 22 is pressed by the first end pressing parts 33*a* and 33*c* is made identical to a timing that the recording medium 22 is pressed by the first center pressing part 33*b*, so that the recording medium 22 can be prevented from being warped as a result that the recording medium 22 is pressed by only one of the first end pressing parts 33*a* and 33*c* and the first center pressing part 33*b*.

Moreover, dimensions in length of the first end pressing parts 33*a* and 33*c* in the width direction (the lateral direction in FIG. 2B) are a minimum dimension capable of pressing the both ends of the recording medium 22 in the width direction. With this configuration, a dimension in length of the first center pressing part 33*b* in the width direction can be larger. Therefore, the first center pressing part 33*b* can press the most portion other than the both ends of the recording medium 22 in the width direction. As a result, it is possible to make smaller the pressing force of the entire nip roller group 33 toward the conveyance belt 31, and to suppress a change in conveying speed of the conveyance belt 31.

Next, description will be given of a second embodiment with reference to FIG. 3. In the first embodiment, description is given of the case where the nip roller group 33 is configured by three components. In the second embodiment, a nip roller group 133 is configured by five components. It is to be noted that the same components as those in the aforementioned first embodiment are denoted by the same reference symbols; therefore, specific description thereof will not be given herein.

Figure 3:
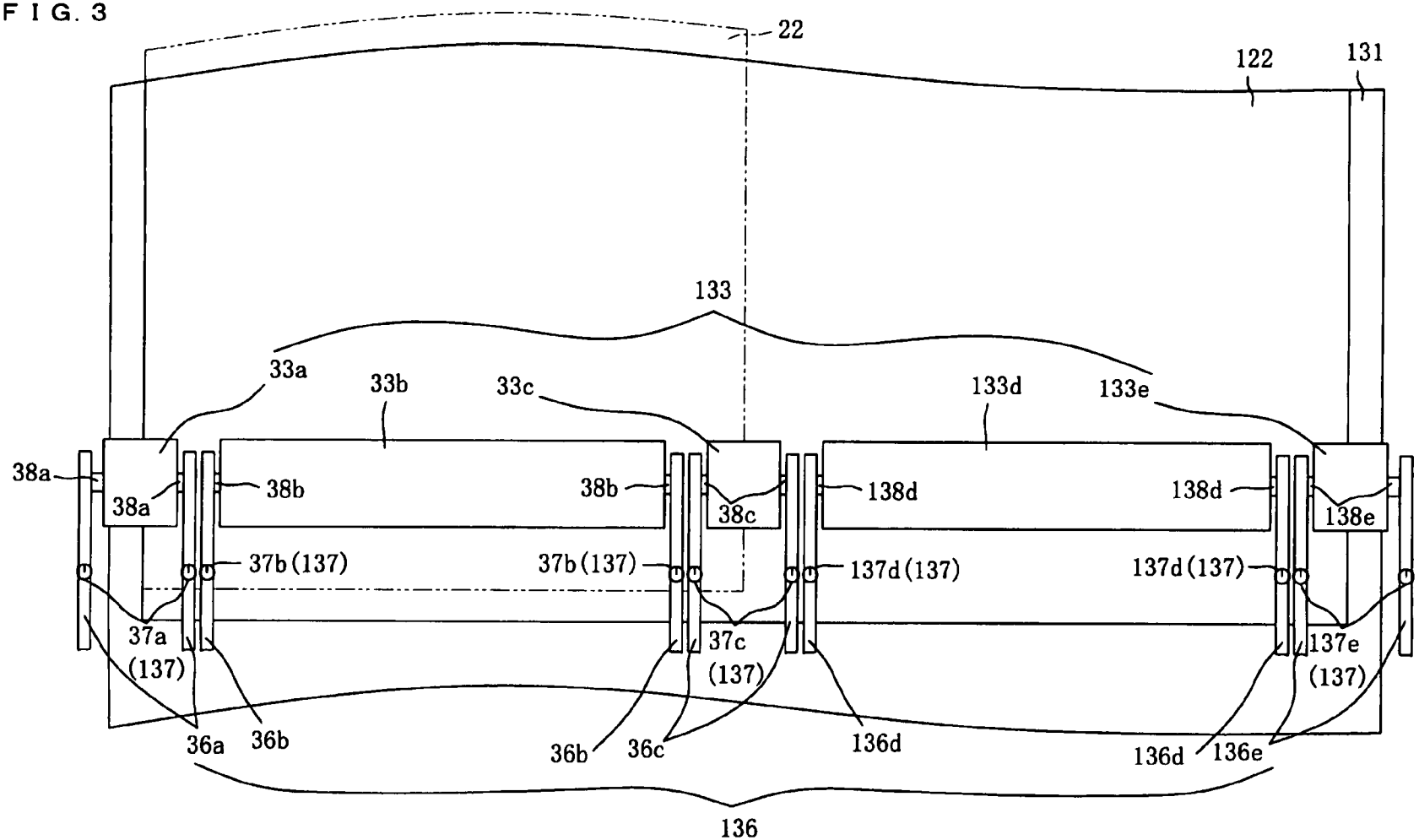
FIG. 3 is a top view of a nip roller group according to a second embodiment.

FIG. 3 is a top view of the nip roller group 133 (nip roller means) in the second embodiment. It is to be noted that lengths in a longitudinal direction of recording media 22 and 122, a conveyance belt 131, and an arm member 136 are not illustrated in FIG. 3.

The conveyance belt 131 is used for holding the recording media 22 and 122 and transferring them toward the stacker 5 (see FIG. 1) (an upward direction in FIG. 3). For the purpose of holding the recording medium 122 having a dimension in length in the width direction which is substantially twice as a dimension in length in the width direction (a lateral direction in FIG. 3) of the recording medium 22 shown by a two-dot chain line, the conveyance belt 131 has a dimension in length larger than that of the recording medium 122.

The recording media 22 and 122 are held on the conveyance belt 131 using one end side (a left side in FIG. 3) in the width direction as a reference irrespective of sizes thereof. With this configuration, the first end pressing part 33*a* can press one ends of the recording media 22 and 122 in the width direction irrespective of the sizes of the recording media 22 and 122.

The sizes of the recording media 22 and 122 in this embodiment correspond to an A6 size and an A4 size (JIS), a B6 size and a B4 size (JIS), or the like. However, it is not necessarily limited thereto. A dimension in length of a second center pressing part 133*d* (which will be described later) in a width direction can be appropriately changed, so that it is possible to adopt to various sizes.

The nip roller group 133 is used for pressing the recording media 22 and 122 held on the conveyance belt 131 toward the conveyance belt 131 (a back side of the paper face of FIG. 3), and is configured by first end pressing parts 33*a* and 33*c*, a first center pressing part 33*b*, a second end pressing part 133*e*, and a second center pressing part 133*d* divided along a conveying direction (a vertical direction in FIG. 3). These parts 33*a*, 33*b*, 33*c*, 133*d* and 133*e* are arranged coaxially upon pressing the conveyance belt 131, and can rotate independently.

The first end pressing parts 33*a* and 33*c*, the first center pressing part 33*b*, the second end pressing part 133*e*, and the second center pressing part 133*d* are formed to have the same diameter.

The arm members 136 are attached to the first end pressing parts 33*a* and 33*c*, the first center pressing part 33*b*, the second end pressing part 133*e* and the second center pressing part 133*d*, respectively. Arm members 136*d* and 136*e* in the arm member 136 have one ends (an upper side in FIG. 3) serving as attachment portions of the second center pressing part 133*d* and the second end pressing part 133*e*, and the other ends (a lower side in FIG. 3) pivotally supported by a main body 1*a* (see FIG. 2A). The arm members 136*d* and 136*e* can turn toward the conveyance belt 131 (the back side of the paper face of FIG. 3).

Springs 137 are fixed to the arm members 36*a*, 36*b*, 36*c*, 136*d* and 136*e*, respectively. Springs 137*d* and 137*e* in the spring 137 have one ends (a front side of the paper face of FIG. 3) fixed to the main body 1*a*, and the other ends (the back side of the paper face of FIG. 3) fixed to upper ends of the arm members 136*d* and 136*e*. The springs 137*d* and 137*e* can bias the arm members 136*d* and 136*e* toward the conveyance belt 131 (the back side of the paper face of FIG. 3). With this biasing force, the arm members 136*d* and 136*e* are biased toward the conveyance belt 131, and the second center pressing part 133*d* and the second end pressing part 133*e* can secure pressing forces toward the conveyance belt 131.

The three end pressing means are used for providing pressing forces for biasing the first end pressing parts 33*a* and 33*c* and the second end pressing part 133*e* toward the conveyance belt 131 to thereby press the conveyance belt 131, and correspond to the arm members 36*a*, 36*c* and 136*e* and the springs 37*a*, 37*c* and 137*e* in this embodiment.

Similarly, the two center pressing means are used for providing pressing forces for biasing the first center pressing part 33*b* and the second center pressing part 133*d* toward the conveyance belt 131 to thereby press the conveyance belt 131, and correspond to the arm members 36*b* and 136*d* and the springs 37*b* and 137*d* in this embodiment.

The springs 137*d* and 137*e* in this embodiment are fixed to the arm members 136*d* and 136*e*, thereby securing pressing forces of the second center pressing part 133*d* and the second end pressing 133*e* toward the conveyance belt 131. However, it is not necessarily limited to this configuration. The springs 137*d* and 137*e* may be fixed to the rotating shafts 138*d* and 138*e* to secure pressing forces of the second center pressing part 133*d* and the second end pressing part 133*e* toward the conveyance belt 131. Thus, the arm members 136*d* and 136*e* can be eliminated.

Moreover, the pressing force of the second end pressing member 133*e* toward the conveyance belt 131 (the back side of the paper face of FIG. 3) is set to be substantially equal to the pressing force of each of the first end pressing parts 33*a* and 33*c*. With this configuration, it is possible to prevent both ends in the width direction of the recording medium 122 having a size (second size) which is larger than the recording medium 22 having a predetermined size (first size) from being separated from the conveyance belt 131. Therefore, it is possible to suppress partial floating of the recording medium 122 from the conveyance belt 131 to thereby prevent degradation of image quality.

In addition, since the pressing force of the second center pressing part 133*d* toward the conveyance belt 131 is set to be substantially equal to the pressing force of the first center pressing part 33*b*, the pressing force toward the entire conveyance belt 131 can be lowered. As a result, at the time of transferring the recording medium 122 having a larger size than that of the recording medium 22 having a predetermined size, it is possible to suppress a change in conveying speed of the conveyance belt 131 to thereby prevent degradation of image quality.

The first end pressing parts 33*a* and 33*c* are arranged so as to press the both ends in the width direction of the recording medium 22 having a predetermined size, and the first end pressing part 33*a* and the second end pressing part 133*e* are arranged so as to press the both ends in the width direction of the recording medium 122 having a larger size than that of the recording medium 22 having a predetermined size. With this configuration, even at the time of transferring the recording media 22 and 122 which are different in size from each other, it is possible to suppress a change in conveying speed of the conveyance belt 131 and partial floating of the recording media 22 and 122 from the conveyance belt 131 to thereby prevent degradation of image quality.

Accordingly, in this embodiment, even in the case of transferring any one of the recording media 22 and 122 which are different in size from each other, the following two effects can be achieved. That is, it is possible to prevent floating of the recording media 22 and 122 from the conveyance belt 131, and to suppress a change in conveying speed between the case where the recording medium 22 or 122 is placed between the nip roller group 133 and the conveyance belt 131 and the case where the recording medium 22 or 122 is not placed between the nip roller group 133 and the conveyance belt 131 to thereby prevent degradation of image quality.

The first end pressing parts 33*a* and 33*c*, the second end pressing part 133*e*, the first center pressing part 33*b*, and the second center pressing part 133*d* are arranged in such a manner that the respective rotating shafts 38*a*, 38*b*, 38*c*, 138*d* and 138*e* are arranged coaxially along the width direction of the conveyance belt 131. With this configuration, a timing that the recording medium 22 is pressed by the nip roller group 133 is made identical to a timing that the recording medium 122 is pressed by the nip roller group 133, so that the recording media 22 and 122 can be prevented from being warped as a result that the recording media 22 and 122 are pressed by only one of the first end pressing parts 33*a* and 33*c*, the second end pressing part 133*e*, the first center pressing part 33*b*, and the second center pressing part 133*d*.

A dimension in length of the second end pressing part 133*e* in the width direction (the lateral direction in FIG. 3) is substantially equal to dimensions in length of the first end pressing parts 33*a* and 33*c*, and a dimension in length of the second center pressing part 133*d* in the width direction is substantially equal to a dimension in length of the first center pressing part 33*b*. Then, since dimensions in length of the first and second center pressing parts 33*b* and 133*d* are larger than dimensions in length of the first and second end pressing parts 33*a*, 33*c* and 133*e*, the first and second center pressing parts 33*b* and 133*d* can press the most portion other than the both ends of the recording medium 122 in the width direction. As a result, it is possible to make the pressing force toward the entire conveyance belt 131 small, and to suppress a change in conveying speed of the conveyance belt 131.

Next, description will be given of a third embodiment with reference to FIGS. 4A and 4B. In the first embodiment, description is given of the case where the nip roller group 33 can rotate independently. In the third embodiment, a nip roller group 233 is integrally provided with respect to a common rotating shaft 238. It is to be noted that the same components as those in the aforementioned embodiments are denoted by the same reference symbols; therefore, detailed description thereof will not be given herein.

Figure 4A:
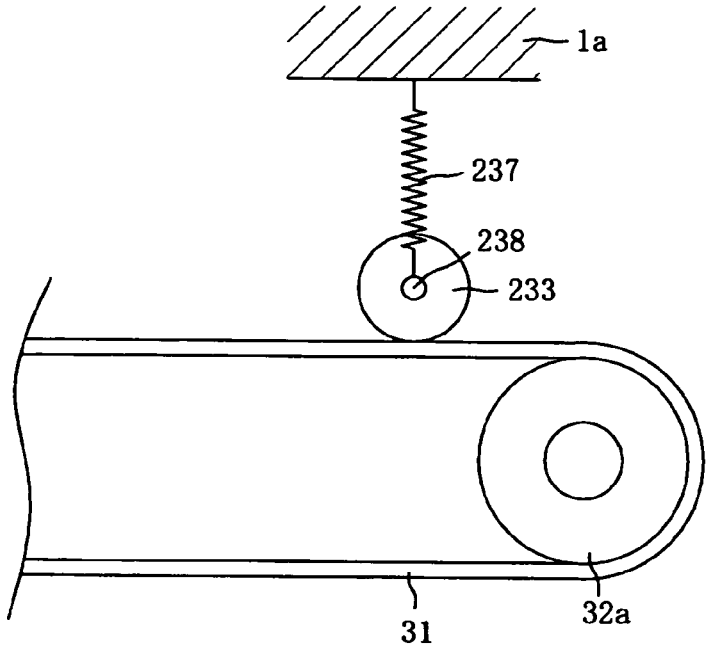
FIG. 4A is a side view of a nip roller group according to a third embodiment.
Figure 4B:
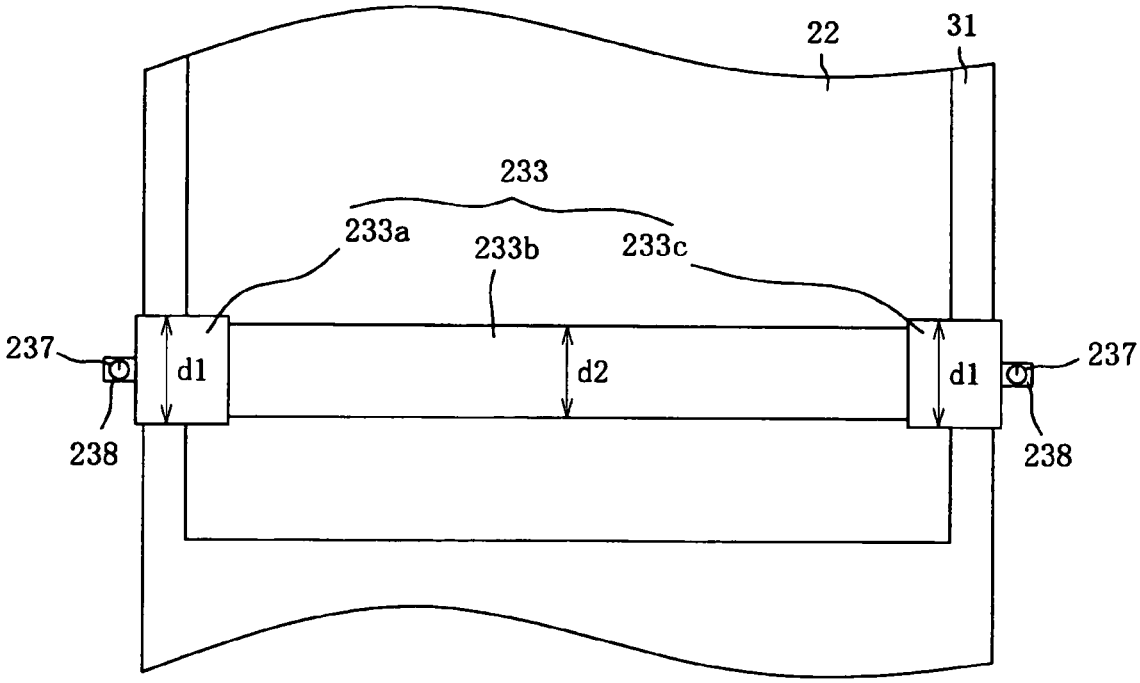
FIG. 4B is a top view of the nip roller group.

FIG. 4A is a side view of the nip roller group 233 (nip roller means) in the third embodiment, and FIG. 4B is a top view of the nip roller group 233 in the third embodiment. It is to be noted that lengths in a longitudinal direction of a main body 1*a* and a conveyance belt 31 are not illustrated in FIG. 4A and lengths in a longitudinal direction of a recording medium 22 and the conveyance belt 31 are not illustrated in FIG. 4B.

As illustrated in FIG. 4A, the nip roller group 233 is used for pressing the recording medium 22 held on the conveyance belt 31, and is pivotally supported by a rotating shaft 238 which will be described later. The nip roller group 233 presses a face of the conveyance belt 31 on which the recording medium 22 is held and, also, rotates in a clockwise direction in FIG. 4A in accordance with movement of the conveyance belt 31.

A spring 237 has one end (an upper side in FIG. 4A) fixed to the main body 1*a* and the other end (a lower side in FIG. 4A) fixed to an upper end of the rotating shaft 238, and can bias the rotating shaft 238 toward the conveyance belt 31 (the lower side in FIG. 4A). With this biasing force, the nip roller group 233 can secure a pressing force toward the conveyance belt 31.

The rotating shaft 238 protrudes from both end faces of the nip roller group 233 in a longitudinal direction (in a direction perpendicular to the paper face of FIG. 4A), and a spring 237 is attached to an upper face the rotating shaft 238.

As illustrated in FIG. 4B, the nip roller group 233 includes first end pressing parts 233*a* and 233*c* arranged at both ends of the recording medium 22 in the width direction (a lateral direction in FIG. 4B), and a first center pressing part 233*b* arranged between the first end pressing parts 233*a* and 233*c*. The first end pressing parts 233*a* and 233*c* and the first center pressing part 233*b* are integrally provided with respect to the common rotating shaft 238.

The entirety pressing means according to the fourth embodiment is used for providing a pressing force for biasing the rotating shaft 238 toward the conveyance belt 31 to thereby allow the first end pressing parts 233*a* and 233*c* and the first center pressing part 233*b* to press the conveyance belt 31, and corresponds to the spring 237 in this embodiment.

The entirety pressing means in this embodiment is configured to fix the spring 237 to the rotating shaft 238. However, it is not necessarily limited to this configuration, and the spring may bias an arm member attached to the rotating shaft.

As described above, a pressing force toward the conveyance belt 31 can be secured by only the arrangement of the entirety pressing means; therefore, components for arranging a plurality of pressing means can be eliminated, resulting in cost reduction of the components.

In this embodiment, the spring 237 is attached to the rotating shaft 238. However, it is not necessarily limited to this configuration. The spring 237 may be attached to an arm member which can turn in a vertical direction (in a direction perpendicular to the paper face of FIG. 4B).

A dimension d1 in outer diameter of each of the first end pressing parts 233*a* and 233*c* is larger than a dimension d2 in outer diameter of the first center pressing part 233*b*. With this configuration, if the first center pressing part 233*b* presses the conveyance belt 31, a pressing force of the first center pressing part 233*b* toward the conveyance belt 31 (a back side of the paper face of FIG. 4B) becomes smaller than pressing forces of the first end pressing parts 233*a* and 233*c* toward the conveyance belt 31. As a result, it is possible to make small a difference between a conveying speed of the conveyance belt 31 in the case where the nip roller group 233 presses the recording medium 22 and a conveying speed of the conveyance belt 31 in the case where the nip roller group 233 presses the conveyance belt 31. Therefore, it is possible to suppress a change in conveying speed due to presence/absence of the recording medium 22 between the nip roller group 233 and the conveyance belt 31 to thereby prevent degradation of image quality.

Since the pressing force of the first center pressing part 233*b* toward the conveyance belt 31 is smaller than the pressing forces of the first end pressing parts 233*a* and 233*c* toward the conveyance belt 31, i.e., since the pressing forces of the first end pressing parts 233*a* and 233*c* toward conveyance belt 31 are larger than the pressing force of the first center pressing force 233*b* toward the conveyance belt 31, the both ends of the recording medium 22 in the width direction (a lateral direction in FIG. 4B) can be strongly pressed against the conveyance belt 31.

With this configuration, the both ends of the recording medium 22 in the width direction is strongly pressed, so that it is possible to prevent the both ends of the recording medium 22 in the width direction from being separated from the conveyance belt 31. As a result, it is possible to suppress partial floating of the recording medium 22 from the conveyance belt 31 to thereby prevent degradation of image quality.

Accordingly, in this embodiment, the following two effects can be achieved. That is, it is possible to prevent floating of the recording medium 22 from the conveyance belt 31, and to suppress a change in a conveying speed between the case where the recording medium 22 is placed between the nip roller group 233 and the conveyance belt 31 and the case where the recording medium 22 is not placed between the nip roller group 233 and the conveyance belt 31 to thereby prevent degradation of image quality.

The conveyance belt 31 in this embodiment has an outer peripheral face made of an elastic material. With this configuration, when the first end pressing parts 233*a* and 233*c* press the conveyance belt 31, the conveyance belt 31 can be elastically deformed. As a result, it is possible to prevent a clearance from being formed between the first center pressing part 233*b* and the conveyance belt 31 when the first end pressing parts 233*a* and 233*c* press the conveyance belt 31, and to allow the first center pressing part 233*b* to press the conveyance belt 31 with reliability.

In this embodiment, description is given of the case where the outer peripheral face of the conveyance belt 31 is made of an elastic material. However, it is not necessarily limited to this configuration. Outer peripheral faces of the first end pressing parts 233*a* and 233*c* may be made of an elastic material. More specifically, an elastic member having a dimension in difference (d1−d2) between a dimension d1 in outer diameter of each of the first end pressing parts 233*a* and 233*c* and a dimension d2 in outer diameter of the first center pressing part 233*b* is wound around both ends of a columnar member having the same diameter in a longitudinal direction. Alternatively, the first end pressing parts 233*a* and 233*c* may be entirely made of an elastic material.

It is desirable that dimensions in length of the first end pressing parts 233*a* and 233*c* in the width direction (the lateral direction in FIG. 4B) are a minimum dimension capable of pressing an end of the recording medium 22 in the width direction. With this configuration, the dimension in length of the first center pressing part 233*b* in the width direction can be larger; therefore, the first center pressing part 233*b* can press the most portion other than the both ends of the recording medium 22 in the width direction. As a result, it is possible to make a pressing force toward the entire conveyance belt 31 small, and to prevent a change in conveying speed of the conveyance belt 31.

Next, description will be given of a fourth embodiment with reference to FIG. 5. In the third embodiment, the nip roller group 233 is configured in such a manner that the three pressing parts 233*a*, 233*b* and 233*c* are integrally provided. In the fourth embodiment, a nip roller group 333 is configured in such a manner that five pressing parts 233*a*, 233*b*, 233*c*, 333*d*, 333*e* are integrally provided. It is to be noted that the same components as those in the aforementioned embodiments are denoted by the same reference symbols; therefore, detailed description thereof will not be given herein.

Figure 5:
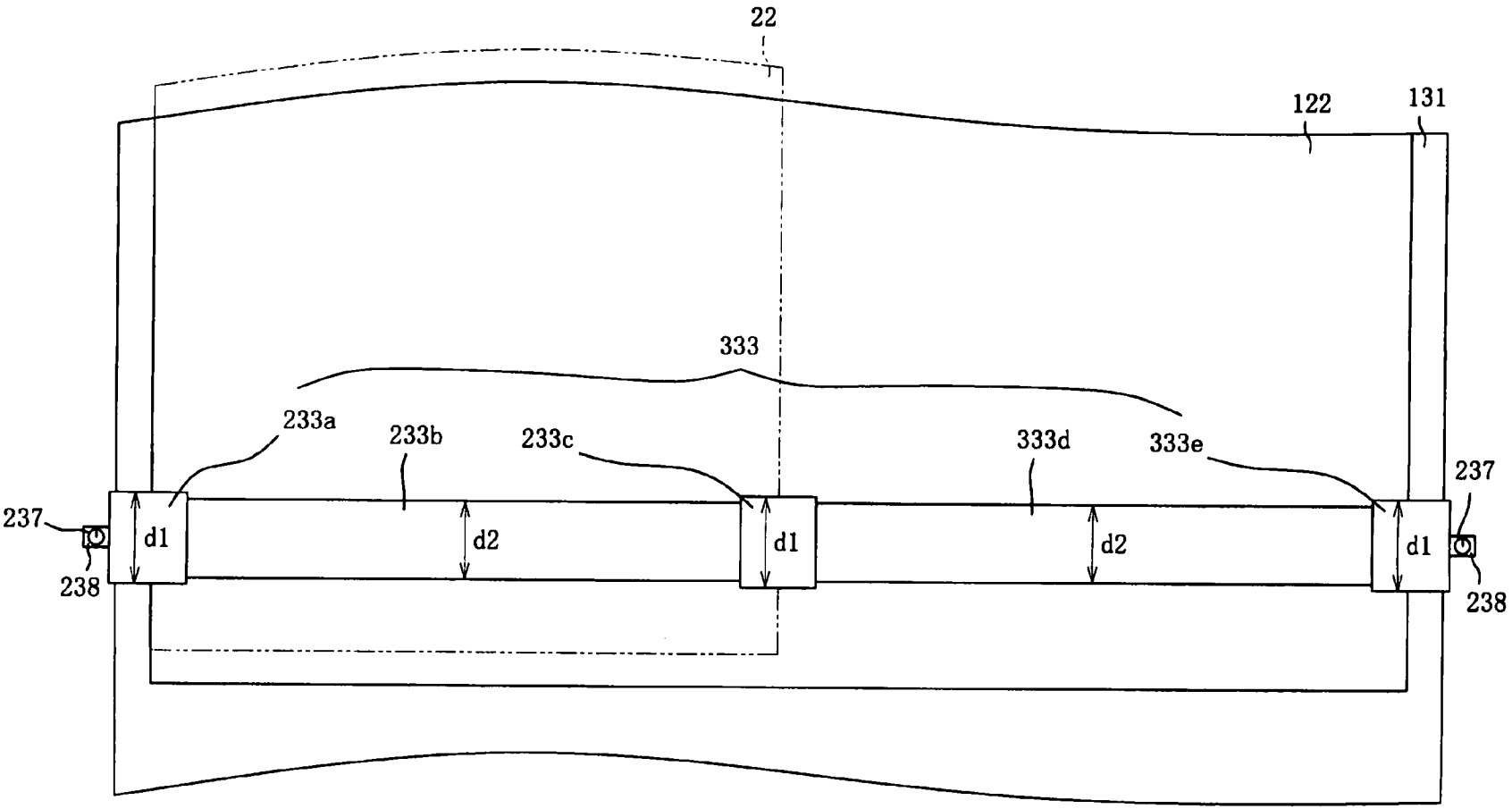
FIG. 5 is a top view of a nip roller group according to a fourth embodiment.

FIG. 5 is a top view of the nip roller group 333 (nip roller means) in the fourth embodiment. It is to be noted that lengths in a longitudinal direction of recording media 22 and 122 and a conveyance belt 131 are not illustrated in FIG. 5.

The nip roller group 333 is used for pressing the recording media 22 and 122 held on the conveyance belt 131 toward the conveyance belt 131 (a back side of the paper face of FIG. 5). The nip roller group 333 includes first end pressing parts 233*a* and 233*c* arranged at both ends of the recording medium 22 in the width direction, a first center pressing part 233*b* arranged between the first end pressing parts 233*a* and 233*c*, a second end pressing part 333*e* arranged at one end (a right side in FIG. 5) of the recording medium 122 in the width direction, and a second center pressing part 333*d* arranged between the second end pressing part 333*e* and the first end pressing part 233*c*. These pressing parts 233*a*, 233*b*, 233*c*, 333*d* and 333*e* are integrally provided with respect to a common rotating shaft 238.

The entirety pressing means is used for providing a pressing force for biasing the rotating shaft 238 toward the conveyance belt 131 to thereby allow the first end pressing parts 233*a* and 233*c*, the first center pressing part 233*b*, the second end pressing part 333*e* and the second center pressing part 333*d* to press the conveyance belt 131, and corresponds to a spring 237 in this embodiment.

The entirety pressing means in this embodiment fixes the spring 237 to the rotating shaft 238. However, it is not necessarily limited to this configuration. The spring may bias an arm member attached to the rotating shaft.

As described above, a pressing force toward the conveyance belt 131 can be secured by only the arrangement of the entirety pressing means; therefore, components for arranging a plurality of pressing means can be eliminated, resulting in cost reduction of the components.

A dimension d1 in outer diameter of the second end pressing part 333*e* is substantially equal to dimension d1 in outer diameter of each of the first end pressing parts 233*a* and 233*c*, and a dimension d2 in outer diameter of the second center pressing part 333*d* is substantially equal to a diameter d2 in outer diameter of the first center pressing part 223*b*. In addition, the dimension d1 in outer diameter of the second end pressing part 333*e* is larger than the dimension d2 in outer diameter of the second center pressing part 333*d*.

With this configuration, if the first and second center pressing parts 233*b* and 333*d* press the conveyance belt 131, pressing forces of the first and second center pressing parts 233*b* and 333*d* toward the conveyance belt 131 (the back side of the paper face of FIG. 5) become smaller than pressing forces of the first and second end pressing parts 233*a*, 233*c* and 333*e* toward the conveyance belt 131. As a result, at the time of transferring the recording medium 122 having a larger size than that of the recording medium 22 having a predetermined size, it is possible to suppress a change in conveying speed of the conveyance belt 131 to thereby prevent degradation of image quality.

Since the pressing forces of the first and second center pressing parts 233*b* and 333*d* toward the conveyance belt 131 are smaller than the pressing forces of the first and second end pressing parts 233*a*, 233*c* and 333*e* toward the conveyance belt 131, i.e., since the pressing forces of the first and second end pressing parts 233*a*, 233*c* and 333*e* toward the conveyance belt 131 are larger than the pressing forces of the first and second center pressing parts 233*b* and 333*d* toward the conveyance belt 131, the both ends of the recording medium 122 in the width direction (the lateral direction in FIG. 5) can be strongly pressed against the conveyance belt 131. As a result, it is possible to prevent the both ends of the recording medium 122 in the width direction from being separated from the conveyance belt 131. Therefore, it is possible to suppress partial floating of the recording medium 122 from the conveyance belt 131 to thereby prevent degradation of image quality.

Accordingly, in this embodiment, the following two effects can be achieved. That is, it is possible to prevent floating of the recording medium 22 from the conveyance belt 131, and to suppress a change in a conveying speed between the case where the recording medium 22 is placed between the nip roller group 333 and the conveyance belt 131 and the case where the recording medium 22 is not placed between the nip roller group 333 and the conveyance belt 131 to thereby prevent degradation of image quality.

The first end pressing parts 233*a* and 233*c* are arranged so as to press the both ends in the width direction of the recording medium 22 having a predetermined size, and the first end pressing part 233*a* and the second end pressing part 333*e* are arranged so as to press the both ends in the width direction of the recording medium 122 having a larger size than that of the recording medium 22 having a predetermined size. With this configuration, even at the time of transferring the recording media 22 and 122 which are different in size from each other, it is possible to suppress a change in conveying speed of the conveyance belt 131 and partial floating of the recording media 22 and 122 from the conveyance belt 131 to thereby prevent degradation of image quality.

The conveyance belt 131 in this embodiment has an outer peripheral face made of an elastic material. With this configuration, when the first and second end pressing parts 233*a*, 233*c* and 333*e* press the conveyance belt 131, the conveyance belt 131 can be elastically deformed. With this configuration, it is possible to prevent a clearance from being formed between the first and second center pressing parts 233*b* and 333*d* and the conveyance belt 131 when the first and second end pressing parts 233*a*, 233*c* and 333*e* press the conveyance belt 131, and to allow the first and second center pressing parts 233*b* and 333*d* to press the conveyance belt 131 with reliability.

In this embodiment, description is given of the case where the outer peripheral face of the conveyance belt 131 is made of an elastic material. However, it is not necessarily limited to this configuration. Outer peripheral faces of the first and second end pressing parts 233*a*, 233*c* and 333*e* may be made of an elastic material. More specifically, an elastic member having a dimension in thickness of a difference (d1–d2) between a dimension d1 in outer diameter of each of the first and second end pressing parts 233*a*, 233*c* and 333*e* and a dimension d2 in outer diameter of the first and second center pressing parts 233*b* and 333*d* is wound around an outer peripheral face of a columnar member having the same diameter. Alternatively, the first and second end pressing parts 233*a*, 233*c* and 333*e* may be entirely made of an elastic material.

A dimension in length of the second end pressing member 333*e* in the width direction (the lateral direction in FIG. 5) is substantially equal to dimensions in length of the first end pressing parts 233*a* and 233*c*, and a dimension in length of the second center pressing part 333*d* in the width direction is substantially equal to a dimension in length of the first center pressing part 233*b*. Dimensions in length of the first and second center pressing parts 233*b* and 333*d* are larger than dimensions in length of the first and second end pressing parts 233*a*, 233*c* and 333*e*. As a result, the first and second center pressing parts 233*b* and 333*d* can press the most portions other than the both ends of the recording medium 122 in the width direction. Therefore, it is possible to make a pressing force toward the entire conveyance belt 131 small, and to suppress a change in conveying speed of the conveyance belt 131.

Although the configuration has been described and illustrated on the basis of the embodiments, it can be readily understood that it is not limited to the aforementioned embodiments, and numerous modifications and variations can be devised without departing from the scope.

For example, an end pressing part and a center pressing part which are different in outer diameter dimension from each other can rotate independently.

The configuration is not limited to an image forming apparatus comprising a line-type recording head. It can be also applied to an image forming apparatus comprising a serial-type recording head, which records an image while allowing a recording head to reciprocately move in a width direction of a sheet of paper. In addition, the configuration is not limited to an inkjet recording apparatus, and is applicable as long as an image forming apparatus is of a type that a recording medium to be recorded is conveyed by a conveyance belt.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an endless conveyance belt which holds and conveys a recording medium a nip roller unit which presses a face of the conveyance belt on which the recording medium is held, rotates in accordance with movement of the conveyance belt, and includes a pair of first end pressing parts, wherein the pair of first end pressing parts comprises a particular first end pressing part and a further first end pressing part which are arranged in a width direction of the conveyance belt and hold edges of the recording medium in the width direction between themselves and the conveyance belt, such that a first portion of each of the first end pressing parts contacts the recording medium at the same time that a second portion of each of the first end pressing parts contacts the conveyance belt, the recording medium having a first size, and a first center pressing part arranged between the first end pressing parts; and a recording head which has a plurality of ink ejecting holes, and ejects ink from the plurality of ink ejecting holes onto the conveyed recording medium to thereby form an image, wherein a pressing force of the first center pressing part toward the conveyance belt is set to be smaller than pressing forces of the pair of first end pressing parts toward the conveyance belt.

2. The image forming apparatus according to claim 1, wherein rotating shafts of the pair of first end pressing parts and the first center pressing part are arranged coaxially along the width direction of the conveyance belt.

3. The image forming apparatus according to claim 1, further comprising:

a pair of end pressing units and a center pressing unit which provide pressing forces for biasing the pair of first end pressing parts and the first center pressing part toward the conveyance belt, respectively, to thereby press the conveyance belt, wherein the pressing force given to the first center pressing part by the center pressing unit is set to be smaller than the pressing forces given to the pair of first end pressing parts by the pair of end pressing units, and the pair of first end pressing parts and the first center pressing part can rotate independently.

4. The image forming apparatus according to claim 1, further comprising:

an entirety pressing unit which provides a pressing force for biasing a common rotating shaft on which the pair of first end pressing parts and the first center pressing part are integrally provided toward the conveyance belt to thereby allow the pair of first end pressing parts and the first center pressing part to press the conveyance belt, wherein dimensions in outer diameter of the pair of first end pressing parts are larger than a dimension in outer diameter of the first center pressing part.

5. The image forming apparatus according to claim 4, wherein at least one of outer peripheral faces of the pair of first end pressing parts and an outer peripheral face of the conveyance belt is made of an elastic material.

6. The image forming apparatus according to claim 1, wherein a dimension in length of the first center pressing part in the width direction of the conveyance belt is larger than dimensions in length of the pair of first end pressing parts.

7. The image forming apparatus according to claim 1, wherein the nip roller unit further includes a second end pressing part, and a second center pressing part arranged between the second end pressing part and one, close to the second end pressing part, of the pair of first end pressing parts, a distance between the second end pressing part and the other one of the first end pressing parts in the width direction of the conveyance belt corresponds to a recording medium having a second size which is larger than the recording medium having a first size, and a pressing force of the second end pressing part toward the conveyance belt is set to be substantially equal to pressing forces of the pair of first end pressing parts and, also, a pressing force of the second center pressing part toward the conveyance belt is set to be substantially equal to a pressing force of the first center pressing part.

8. The image forming apparatus according to claim 7, wherein rotating shafts of the pair of first end pressing parts, the second end pressing part, the first center pressing part, and the second center pressing part are arranged coaxially along the width direction of the conveyance belt.

9. The image forming apparatus according to claim 7, further comprising:

three end pressing units and two center pressing units which provide pressing forces for biasing the pair of first end pressing parts, the second end pressing part, the first center pressing part, and the second center pressing part toward the conveyance belt, respectively, to thereby press the conveyance belt, wherein the pressing forces given to the first and second center pressing parts by the two center pressing units are set to be smaller than the pressing forces given to the pair of first end pressing parts and the second end pressing part by the three end pressing units, and the pair of first end pressing parts, the second end pressing part, the first center pressing part, and the second center pressing part can rotate independently.

10. The image forming apparatus according to claim 7, further comprising:

an entirety pressing unit which provides a pressing force for biasing a common rotating shaft on which the pair of first end pressing parts, the second end pressing part, the first center pressing part, and the second center pressing part are integrally provided toward the conveyance belt to thereby allow the pair of first end pressing parts, the second end pressing part, the first center pressing part, and the second center pressing part to press the conveyance belt, wherein a dimension in outer diameter of the second end pressing part is substantially equal to dimensions in outer diameter of the pair of first end pressing parts, a dimension in outer diameter of the second center pressing part is substantially equal to a dimension in outer diameter of the first center pressing part, and the dimensions in outer diameter of the first and second end pressing parts are larger than the dimensions in outer diameter of the first and second center pressing parts.

11. The image forming apparatus according to claim 10, wherein at least one of outer peripheral faces of the first and second end pressing parts and an outer peripheral face of the conveyance belt is made of an elastic material.

12. The image forming apparatus according to claim 7, wherein dimensions in length of the first and second center pressing parts in the width direction of the conveyance belt are larger than dimensions in length of the first and second end pressing parts.

* * * * *